US010587035B2

(12) United States Patent
Freebury et al.

(10) Patent No.: US 10,587,035 B2
(45) Date of Patent: Mar. 10, 2020

(54) DEPLOYABLE REFLECTOR

(71) Applicant: TENDEG LLC, Louisville, CO (US)

(72) Inventors: Gregg E. Freebury, Louisville, CO (US); Neal J Beidleman, Aspen, CO (US)

(73) Assignee: TENDEG LLC, Louisville, CO (US)

( * ) Notice: Subject to any disclaimer, the term of this patent is extended or adjusted under 35 U.S.C. 154(b) by 0 days.

(21) Appl. No.: 16/377,013

(22) Filed: Apr. 5, 2019

(65) Prior Publication Data

US 2019/0237859 A1 Aug. 1, 2019

Related U.S. Application Data

(63) Continuation of application No. 15/387,437, filed on Dec. 21, 2016, now Pat. No. 10,256,530.

(60) Provisional application No. 62/288,350, filed on Jan. 28, 2016.

(51) Int. Cl.
*H01Q 1/28* (2006.01)
*H01Q 15/16* (2006.01)

(52) U.S. Cl.
CPC ..... *H01Q 1/288* (2013.01); *H01Q 15/161* (2013.01)

(58) Field of Classification Search
CPC .... H01Q 1/288; H01Q 15/161; H01Q 15/168; H01Q 15/20; H01Q 1/08; H01Q 1/081
See application file for complete search history.

(56) References Cited

U.S. PATENT DOCUMENTS 3,281,849 A * 10/1966 Andreasen ..... H01Q 15/04 343/753
4,885,891 A * 12/1989 Lynch ..... E04H 15/50 52/646
5,680,145 A * 10/1997 Thomson ..... H01Q 1/288 343/915
5,990,851 A * 11/1999 Henderson ..... H01Q 1/081 343/840
6,028,570 A * 2/2000 Gilger ..... H01Q 1/288 343/880
6,225,965 B1 * 5/2001 Gilger ..... H01Q 1/288 343/912
6,388,637 B1 * 5/2002 Davis ..... H01Q 1/288 343/781 P (Continued)

FOREIGN PATENT DOCUMENTS

JP H11 293776 10/1999
JP H11 293777 10/1999

OTHER PUBLICATIONS

Corresponding European Patent Application No. 17744669.7; Extended European Search Report dated Aug. 13, 2019, 9 pages.

*Primary Examiner* — Dameon E Levi
*Assistant Examiner* — Jennifer F Hu
(74) *Attorney, Agent, or Firm* — Craig R. Miles; CR Miles P.C.

(57) ABSTRACT

A reflector assembly including a truss engaging the first net at a first plurality of points along the first net perimeter edge and engaging a second net at a second plurality of points along the second net perimeter edge. A truss deployment assembly moves the truss between a truss stowed condition and a truss deployed condition, the truss in the truss deployed condition tensioning said first net or said second net to maintain a substantially flat or parabolic net outer surface. A reflector disposed at the first net sends or receives remote data.

12 Claims, 17 Drawing Sheets

(56) References Cited

U.S. PATENT DOCUMENTS

| | | | | |
|---|---|---|---|---|
| 10,263,316 | B2 * | 4/2019 | Harvey | H01Q 1/1235 |
| 2001/0050657 | A1 * | 12/2001 | Meguro | B64G 1/222<br>343/915 |
| 2005/0104798 | A1 * | 5/2005 | Nolan | H01Q 1/08<br>343/915 |
| 2006/0181788 | A1 * | 8/2006 | Harada | G02B 7/183<br>359/841 |
| 2015/0288072 | A1 * | 10/2015 | Medzmariashvili | H01Q 1/1235<br>343/881 |

* cited by examiner 44
46
47
60,65
63
95
98
99
100
101
102
103
104
105
106
107
108
109
110
97

DEPLOYABLE REFLECTOR

CROSS-REFERENCE TO RELATED APPLICATIONS

This United States Patent Application is a continuation of U.S. patent application Ser. No. 15/387,437, filed Dec. 21, 2016, now U.S. Pat. No. 10,256,530, issued Apr. 9, 2019, which claims the benefit of U.S. Provisional Patent Application No. 62/288,350, filed Jan. 28, 2016, each hereby incorporated by reference herein.

GOVERNMENT LICENSE RIGHTS

This invention was made with government support under Contract Number NNX15CP76P awarded by NASA JPL SBIR Program Office. The government has certain rights in this invention.

DETAILED DESCRIPTION OF THE INVENTION

Figure 1:
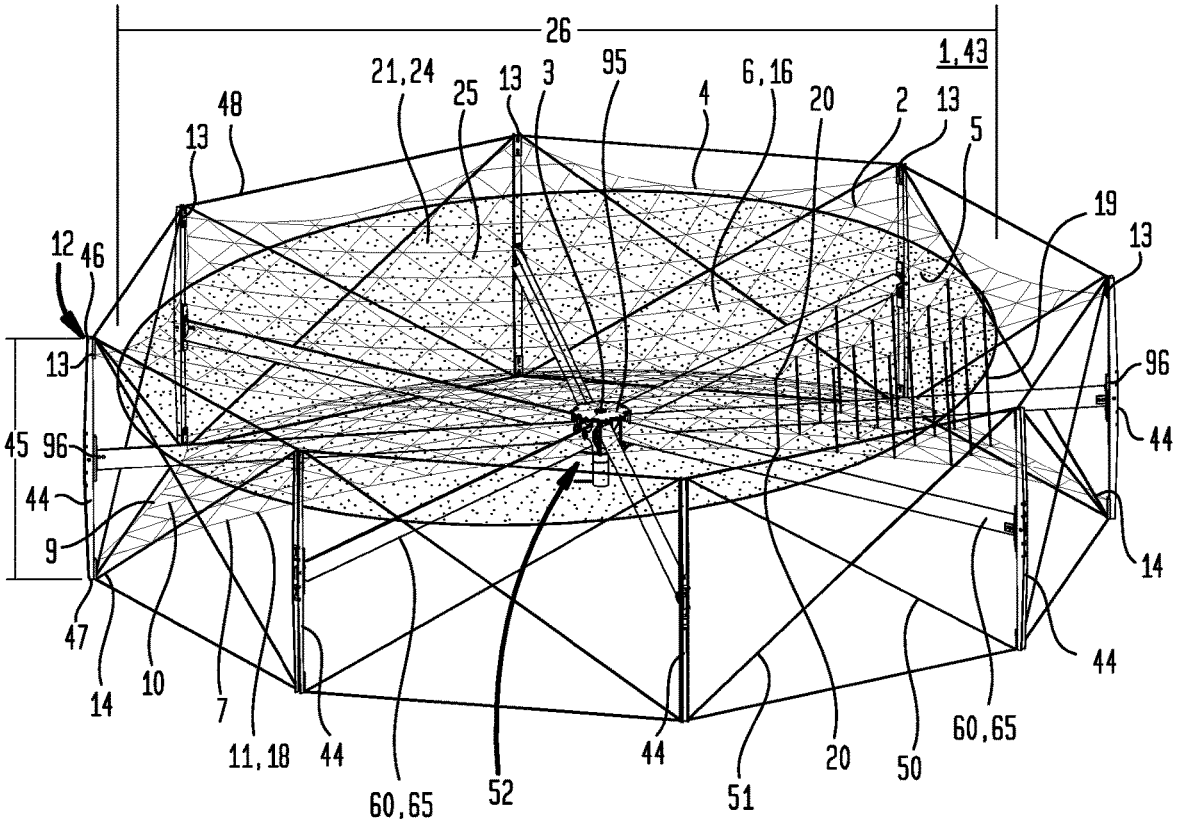
FIG. 1 illustrates a perspective view of an embodiment of a reflector assembly including a first net and second net (shown in part) tensioned by deployment assembly in a configuration of a parabolic reflector.

Now referring primarily to FIGS. 1 through 4, a reflector assembly (1) can include one or more of: a first net (2) extending from a first net center (3) to a first net perimeter edge (4), the first net (2) having a first net inner surface (5) and a first net outer surface (6); a second net (7) extending from a second net center (8) to a second net perimeter edge (9), the second net (7) having a second net inner surface (10) and a second net outer surface (11), the first net inner surface (5) facing the second net inner surface (10) (the first and second nets partially omitted to expose components of a deployment assembly); a truss (12) engaging the first net (2) at a first plurality of points (13) along the first net perimeter edge (4) and to the second net (7) at a second plurality of points (14) along the second net perimeter edge (9), the truss (12) tensioning each of the first net (2) and the second net (7) to maintain a flat first net outer surface (15)(as shown in the illustrative example of FIGS. 3 and 4) or a parabolic first net outer surface (16) extending from the first net center (3) to the first net perimeter edge (4)(as shown in the illustrative example of FIGS. 1 and 2) and a flat second net outer surface (17) or a parabolic second net outer surface (18) extending from the second net center (8) to the second net perimeter edge (9).

Again referring primarily to FIGS. 1 through 4, the first net (2) and the second net (7) of the reflector assembly (1) can, but need not necessarily, be attached to each other by a plurality of tension ties (19) extending between corresponding net polyhedron vertices (20) (an illustrative portion of the plurality of tension ties shown). The plurality of tension ties (19) can aid in achieving the flat or parabolic first net outer surface (15)(16) or the flat or parabolic second net outer surface (17)(18).

Figure 2:
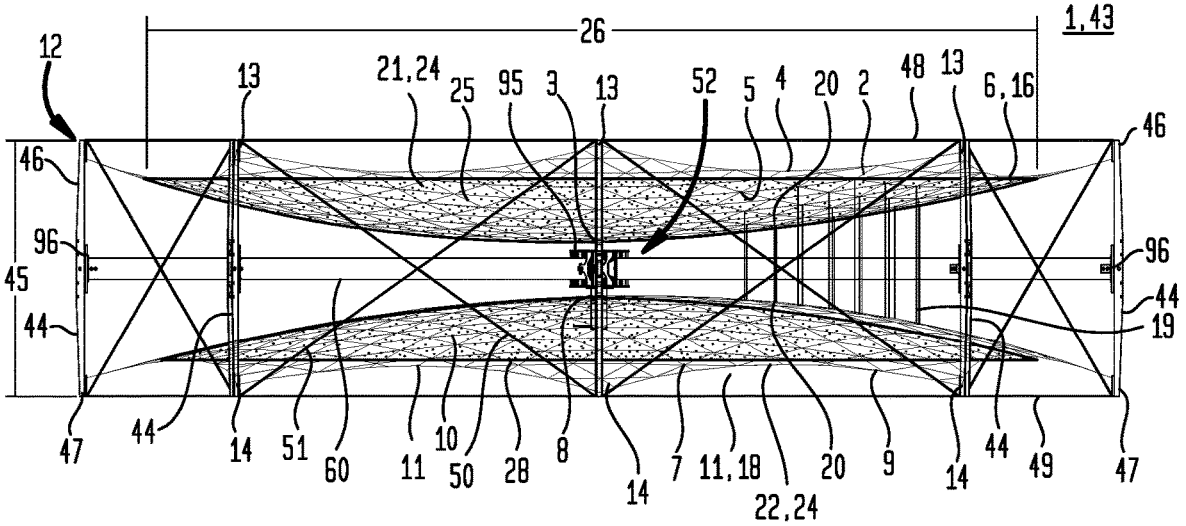
FIG. 2 illustrates a side view of the embodiment of the reflector assembly having a parabolic reflector surface.
Figure 3:
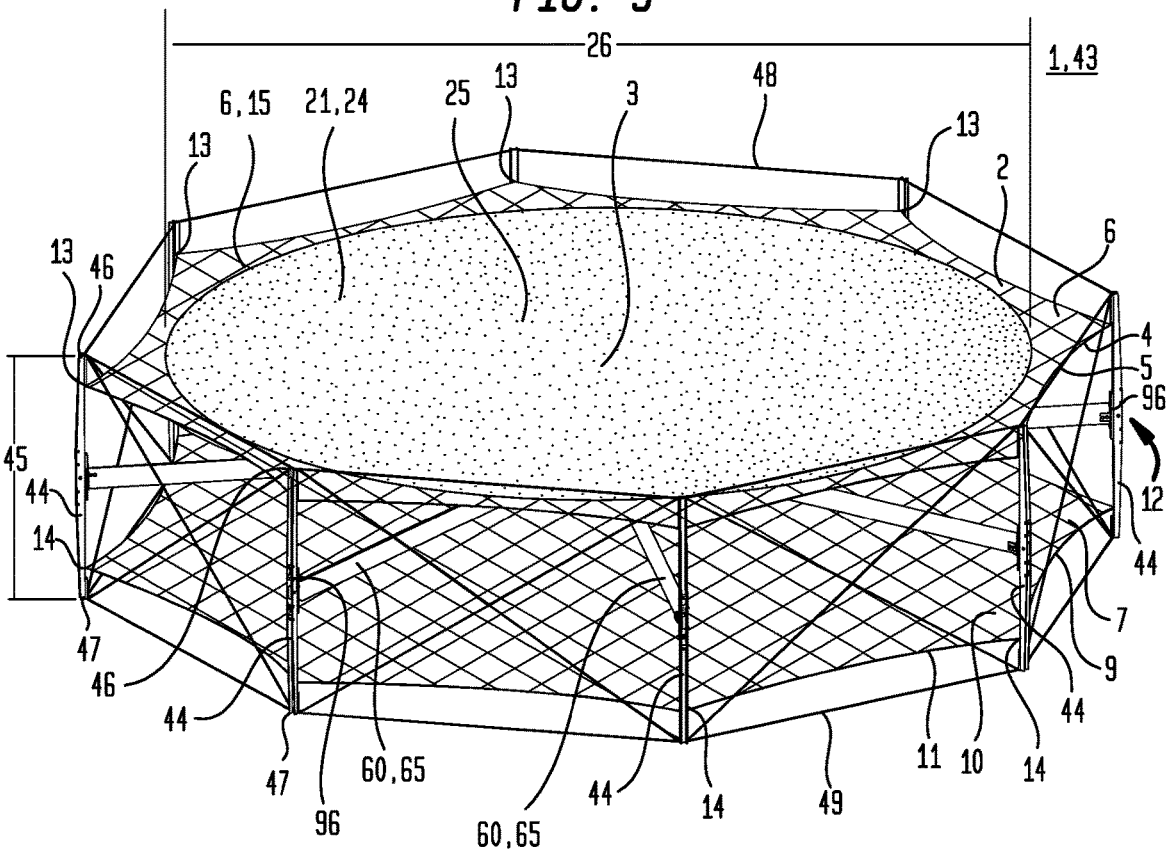
FIG. 3 illustrates a perspective of an embodiment of the reflector assembly having a flat reflector surface.
Figure 4:
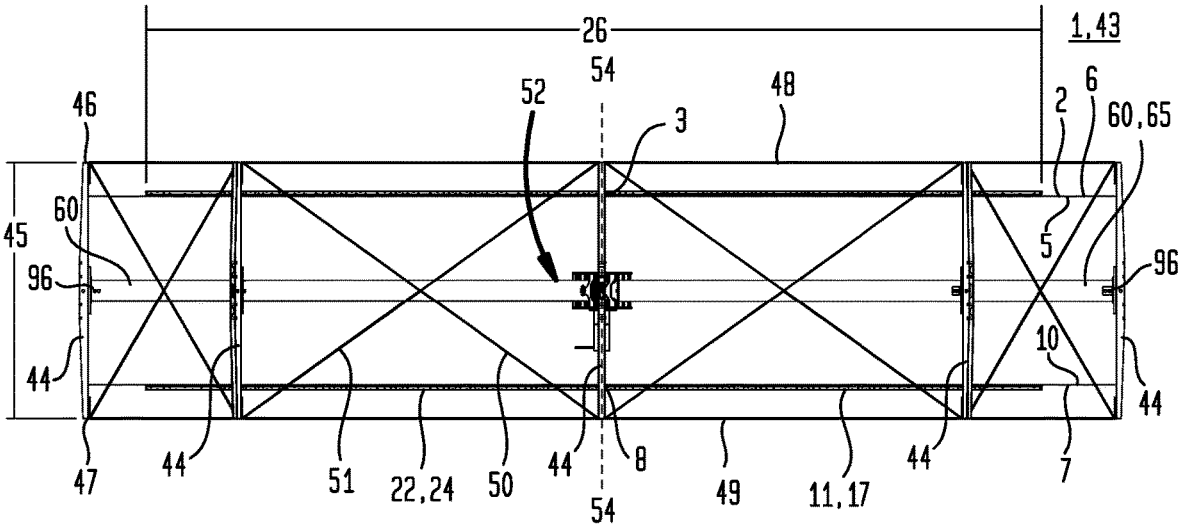
FIG. 4 illustrates a side view of the embodiment of the reflector assembly having a flat reflector surface.

As further shown in FIGS. 1 through 6, the reflector assembly (1) can further include a first reflector (21) disposed at the first net (2), and as to particular embodiments, a second reflector (22) disposed at the second net (7) (as shown by stippled area in the example of FIGS. 1 and 2). The first or second reflector (21)(22) can receive and reflect electromagnetic waves (23)(as shown in the illustrative examples of FIGS. 5 and 6). The first or second reflector (21)(22) can, as illustrative examples, include one or more of: a reflective membrane, a reflective mesh, a reflective phased array, a reflectarray, or the like. As to particular embodiments, the first or second reflector (21)(22) can, but need not necessarily, be a reflective membrane (24) integrated with the first net (2) or the second net (7). As to certain embodiments, the reflective membrane (24) can be integrated or one-piece with the first net (2) or the second net (7) at the first or second net inner or outer surfaces (5)(10)(6)(11). The first reflector (24) can have a first reflector surface (25) defining a reflector aperture (26)(as shown in the illustrative example of FIGS. 1 and 2) of between about 1 meter and about 5 meters (or therebetween in increments of 50 millimeters); however, this is not intended to preclude embodiments which define a lesser or greater reflector aperture (26).

Now referring primarily to FIGS. 1 through 6, as to particular embodiments, the first reflector (21) can have a first reflector surface (25) which receives and reflects electromagnetic waves (23)(as shown in the examples of FIGS. 1 through 4) having a first frequency band (27). The second reflector (22) can have a second reflector surface (28) configured to receive and reflect electromagnetic waves (23) having a second frequency band (29). As to particular embodiments, the first and second frequency bands (27)(29) may be delimited by upper and lower frequencies that are the same, substantially the same, or overlap with use of the first and second frequency bands (27)(29) time separated to avoid blockage or sensitivity impairment. As to particular embodiments, the first frequency band (27) and the second frequency band (29) can be delimited by upper and lower frequencies that do not overlap and define a bad gap between the first frequency band (27) and the second frequency band (29), or may overlap to an extent that the first frequency band (27) and the second frequency band (29) can be used concurrently each maintaining sensitivity sufficient for the intended application.

Figure 5:
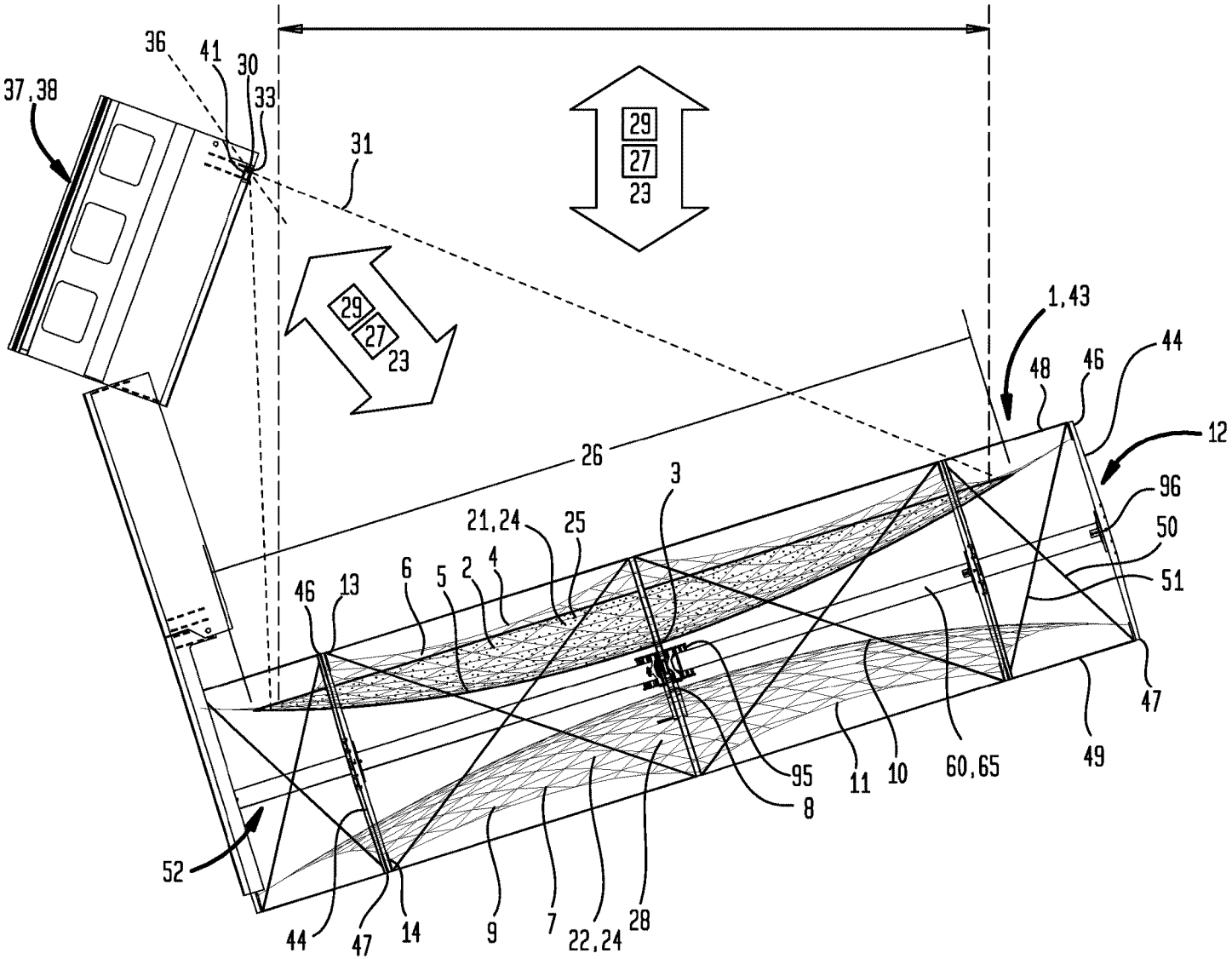
FIG. 5 illustrates an embodiment of the reflector assembly having an offset fed configuration.
Figure 6:
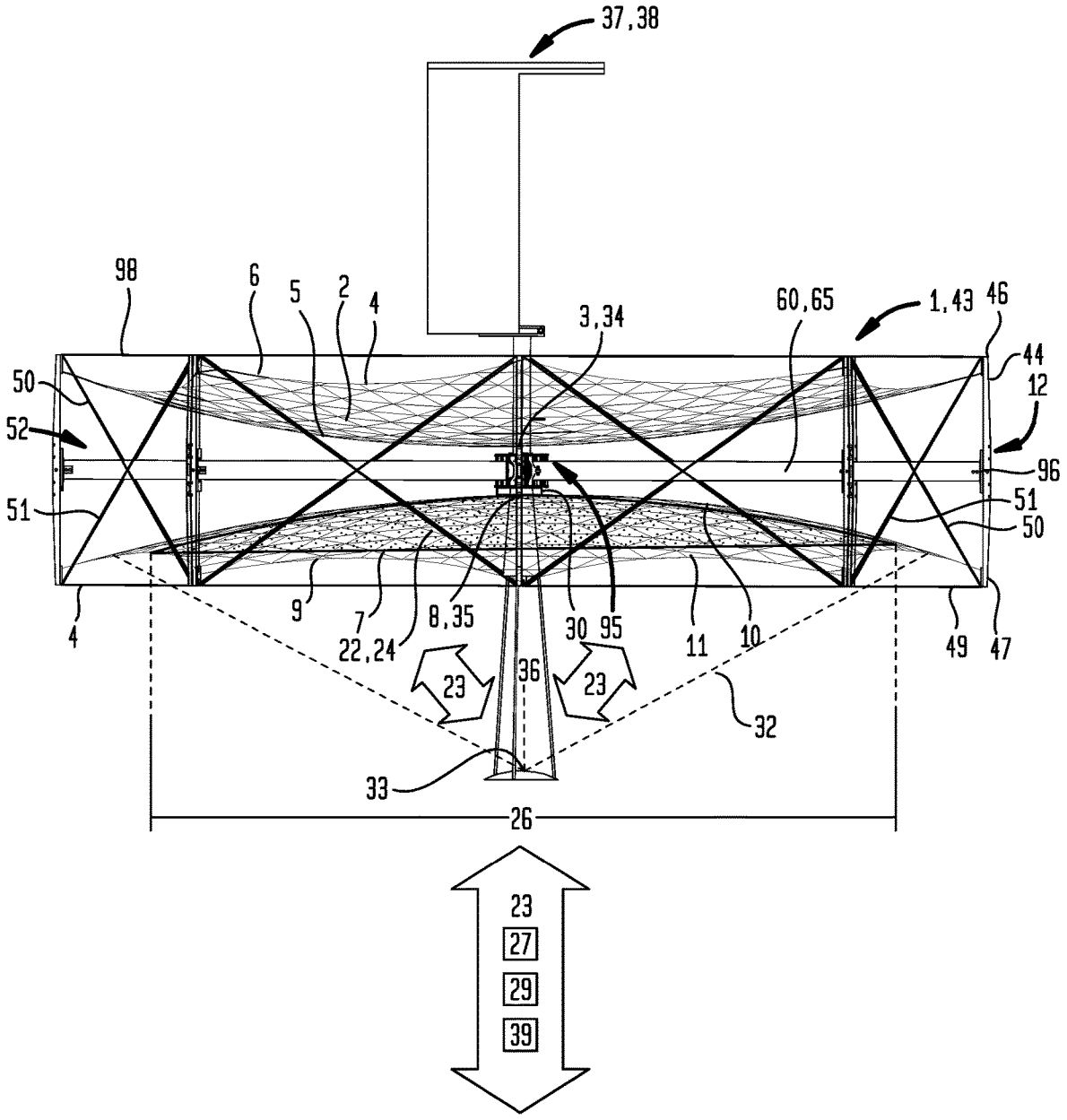
FIG. 6 illustrates an embodiment of the reflector assembly having a center fed configuration.

Now referring primarily to FIGS. 5 and 6, the reflector antennas (30) may be offset fed (31)(as shown in the illustrative example of FIG. 5) or center fed (32) (as shown in the illustrative example of FIG. 6). Offset fed (31) means a focal point (33) of the reflected electromagnetic waves (23) is offset from the first reflector (21). This allows the first reflector (21) to have a continuous first reflector surface (25); although an offset fed reflector antenna (30) does not preclude use of a discontinuous first reflector surface (25). Center fed (as shown in the example of FIG. 6) means the focal point (33) of the reflected electromagnetic waves (23) occurs above the first reflector surface (25) and may, but need not necessarily, be substantially aligned with the first reflector center (34) with the first reflector surface (25) being substantially symmetric about the focal axis (36).

Figure 7:
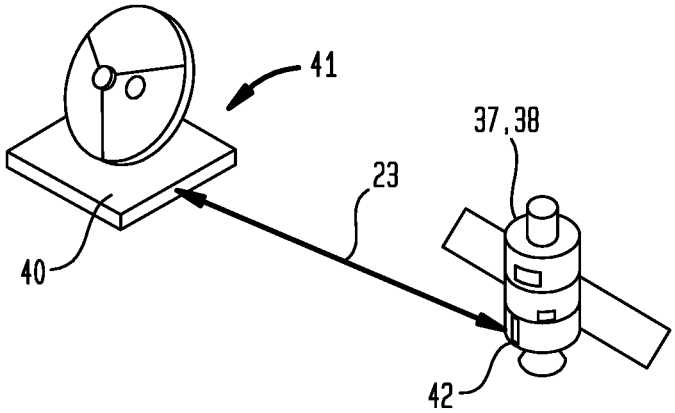
FIG. 7 illustrates a method of sending and receiving remote data using embodiments of the reflector assembly.

Now referring primarily to FIGS. 5 through 7, the reflector assembly (1) can, but need not necessarily, include a spacecraft (37), a satellite (38), or other aerospace system. Embodiments can include a method for remote sensing, comprising receiving remote sensing data (39)(as shown in the example of FIGS. 5 and 6) where the remote sensing data (39) is captured with a reflector assembly (1) associated with a satellite (38) and communicated to a receiver (41) including a computing device (40), where the reflector assembly (1) further comprises a first net (2) extending from a first net center (3) to a first net perimeter edge (4), the first net (2) having a first net inner surface (5) and a first net outer surface (6); a second net (7) extending from a second net center (8) to a second net perimeter edge (9), the second net (7) having a second net inner surface (10) facing the first net inner surface (5); a first reflector (21) disposed at the first net (2); a truss (12) engaged to the first net (2) at a first plurality of points (13) along the first net perimeter edge (9) and to the second net (7) at a corresponding second plurality of points (14) along the second net perimeter edge (9), each of the first plurality of points (13) being aligned with one of the corresponding second plurality of points (14); and the truss (12) having a stowed condition (42)(as shown in the illustrative examples of 19 through 21) and a deployed condition (43), where the deployed condition (43) maintains a flat or parabolic first net outer surface (15)(16) extending from the first net center (3) to the first net perimeter edge (4) and a flat or parabolic second net outer surface (17)(18) extending from the second net center (8) to the second net perimeter edge (9). However, this illustrative example does not preclude implementations in which the reflector assembly (1) attaches to a terrestrial support structure for a ground based, ship-based, aircraft-based, or similar terrestrial system. The support structure may be a static structure like a tripod or an actively controlled support structure like a gimbal that is pointing the reflector assembly (1) to another source such as a satellite or terrestrial source of electromagnetic waves (23).

Now referring generally to FIGS. 1 through 8A, 8B, 23 and 24, as one illustrative embodiment, the truss (12) can include a plurality of battens (44). The plurality of battens (44) can each have a batten length (45) disposed between a batten first end (46) and a batten second end (47). Each of the plurality of battens (44) extend between one of the first plurality of points (13) of the first net (2) coupled to or coupled proximate or connected to the batten first end (46) and a corresponding one of the second plurality of corresponding points (14) of the second net (7) coupled to or coupled proximate or connected to the batten second end (47).

Particular embodiments of the truss (12) can, but need not necessarily, include at least a first longeron (48) connecting each of the plurality of battens (44) to an adjacent one of the plurality of battens (44) at or proximate to the batten first ends (46). Embodiments can, but need not necessarily, include a second longeron (49) connecting each of the plurality of battens (44) to an adjacent one of said plurality of battens (44) at or proximate the batten second ends (47).

Particular embodiments of the truss (12) can, but need not necessarily, include a first diagonal member (50) connecting the batten first end (46) of each of said plurality of battens (44) to a batten second end (47) of the adjacent one of the plurality of battens (44). Embodiments, can, but need not necessarily, include a second diagonal member (51) connecting said batten second end (47) of each of the plurality of battens (44) to a batten first end (46) of the adjacent one of the plurality of battens (44).

Figure 8A:
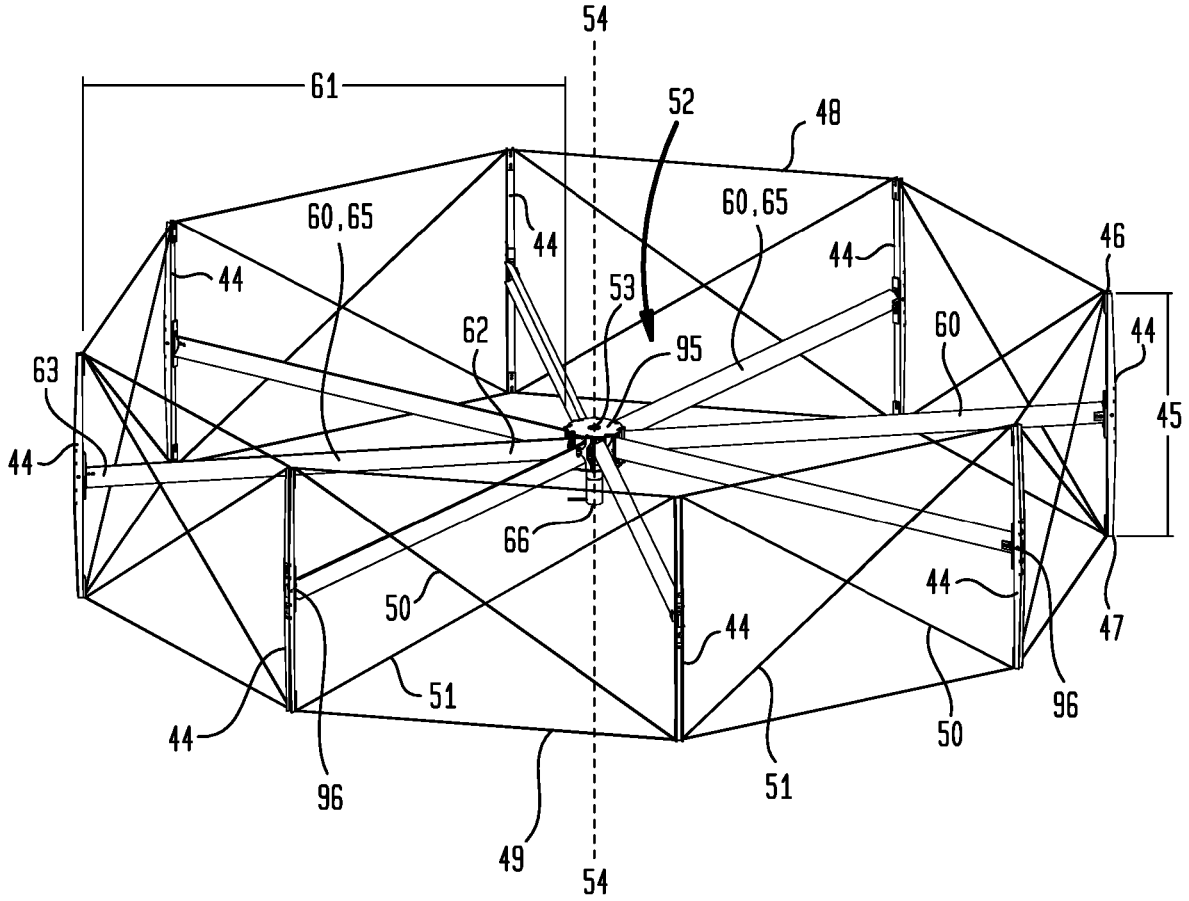
FIG. 8A illustrates a perspective view of an embodiment of a truss deployment assembly having plurality of axially extended ribs each joined at the center of a corresponding batten.
Figure 8B:
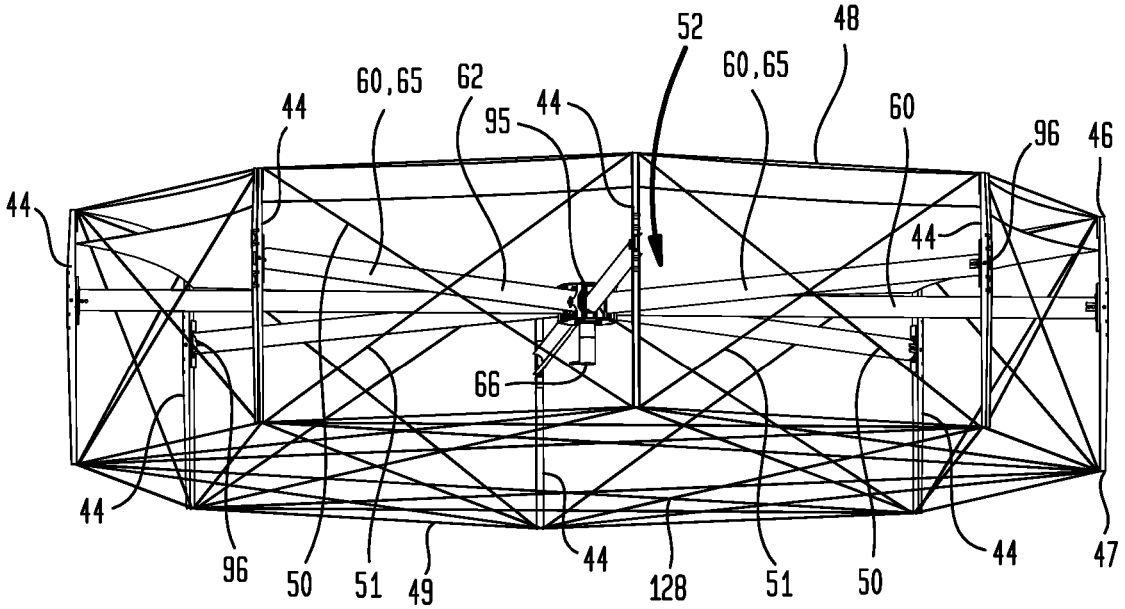
FIG. 8B illustrates a perspective view of an embodiment of a truss deployment assembly having plurality of axially extended ribs each joined to a corresponding batten off center toward a batten first end and further including cross members extending between non-adjacent batten second ends.

Now referring primarily to FIGS. 8A and 8B, as to particular embodiments the truss deployment assembly (52)

can include a plurality of axially extended ribs (60) each joined medially or at the center of a corresponding one of the plurality of battens (44). As to these embodiments, the first longeron (48) or the second longeron (49)(or both) can tension and maintain the configuration of the truss (12)(as shown in the example of FIG. 8A). As to particular embodiments the truss deployment assembly (52) can include a plurality of axially extended ribs (60) each joined to the corresponding one of the plurality of battens (44) offset from the center of the batten (44) toward the batten first end (46). As to these embodiments, a plurality of cross members (128) can assist the first longeron (48) or the second longeron (49) to tension and maintain the configuration of the truss (12)(as shown in the example of FIG. 8B). The plurality of cross members (128) can each couple a pair of non-adjacent batten second ends (47). Where the plurality of axially extended ribs (60) each join a corresponding one of the plurality of battens (44) offset from the center of the batten (44) toward the batten second end (46), the cross members can be the plurality of cross members (128) can each couple a pair of non-adjacent batten first ends (46).

The first and second net (2)(7), the first and second longerons (48)(49), and the first and second diagonal members (50)(51), may be made from a variety of pliant, flexible or elastic rods, cordage, wires, or lines whether solid, tubular, or stranded produced from natural materials or synthetic materials or combinations thereof.

Embodiments of the truss (12) can be reversibly disposed between a truss deployed condition (43) (as shown in the illustrative examples of FIGS. 1 through 8, 23 and 24) and truss stowed condition (42)(as shown in the illustrative examples of FIGS. 19 through 21 with nets, longerons, and diagonals omitted) by affixing or operation of a truss deployment assembly (52).

Figure 9A:
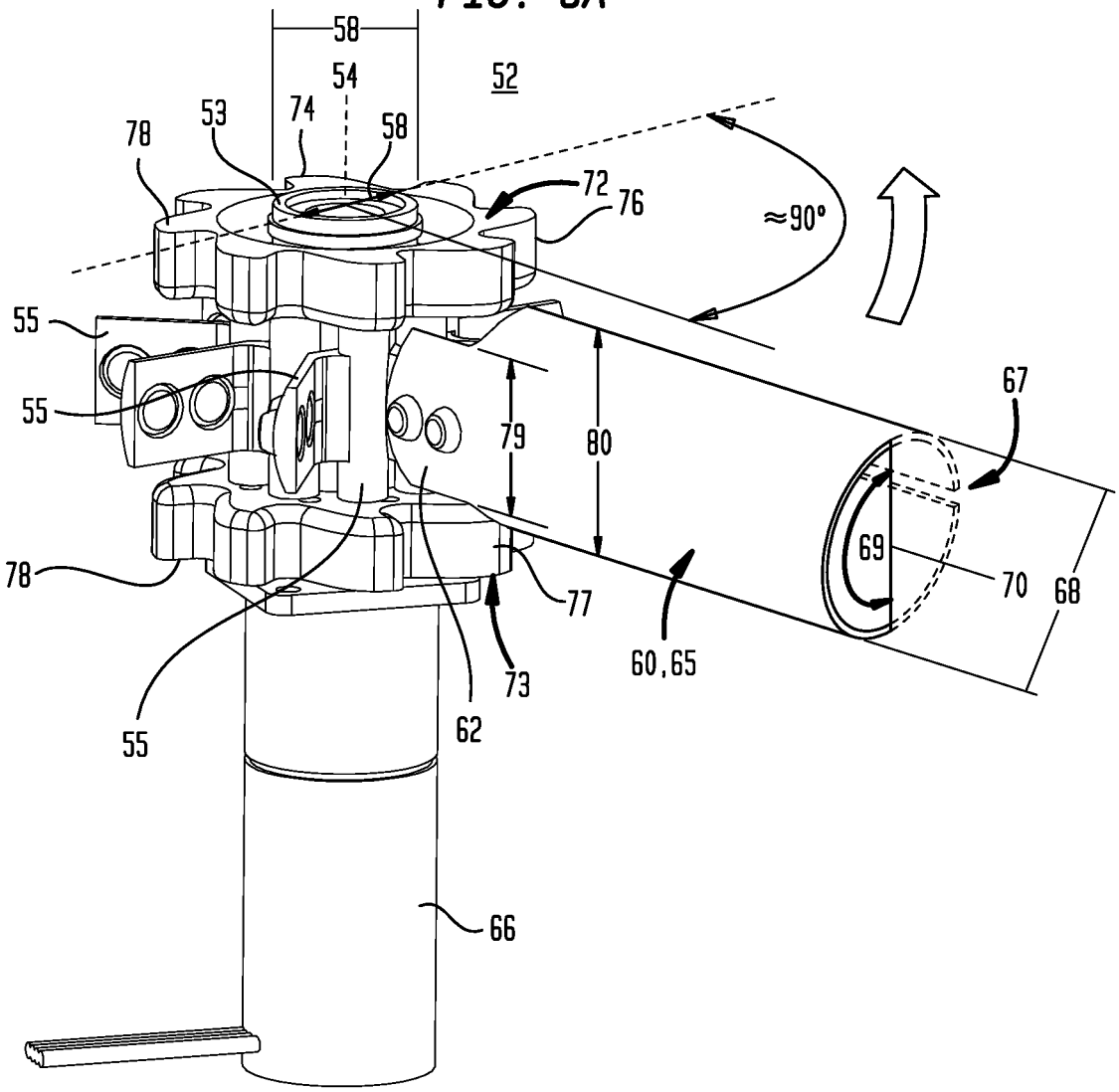
FIG. 9A illustrates a perspective view of an embodiment of a spool of the truss deployment assembly shown FIG. 8.
Figure 10:
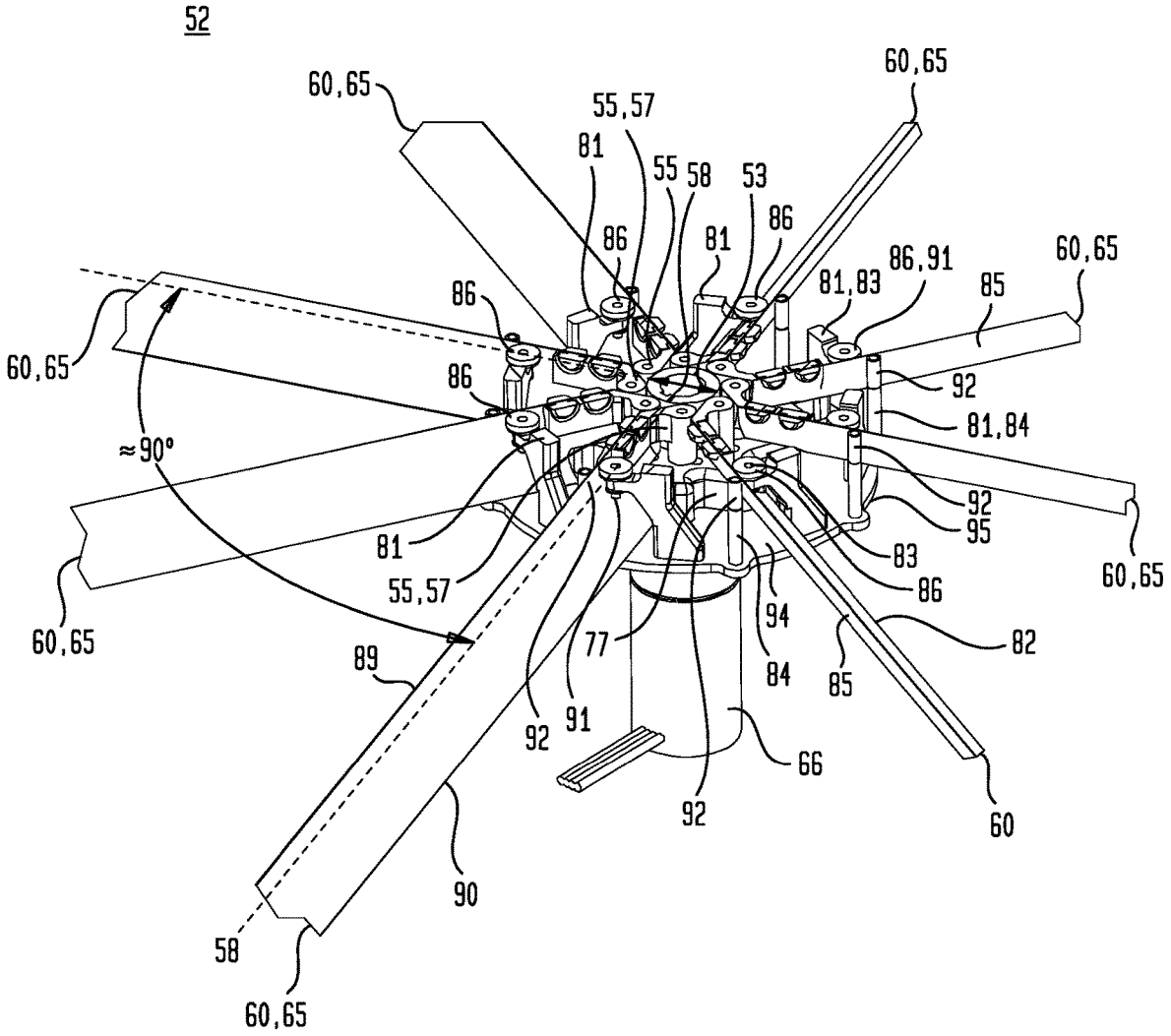
FIG. 10 illustrates a perspective cross sectional view of an embodiment of the spool of the truss deployment assembly shown FIG. 8A.

Now referring primarily to FIGS. 9A and 10, an illustrative embodiment of the truss deployment assembly (52) can include a spool (53) rotatable about a spool longitudinal center axis (54). The spool longitudinal axis (54) can be aligned with the first net center (3) and the second net center (8)(as shown in the illustrative examples of FIGS. 1 and 2).

Figure 11:
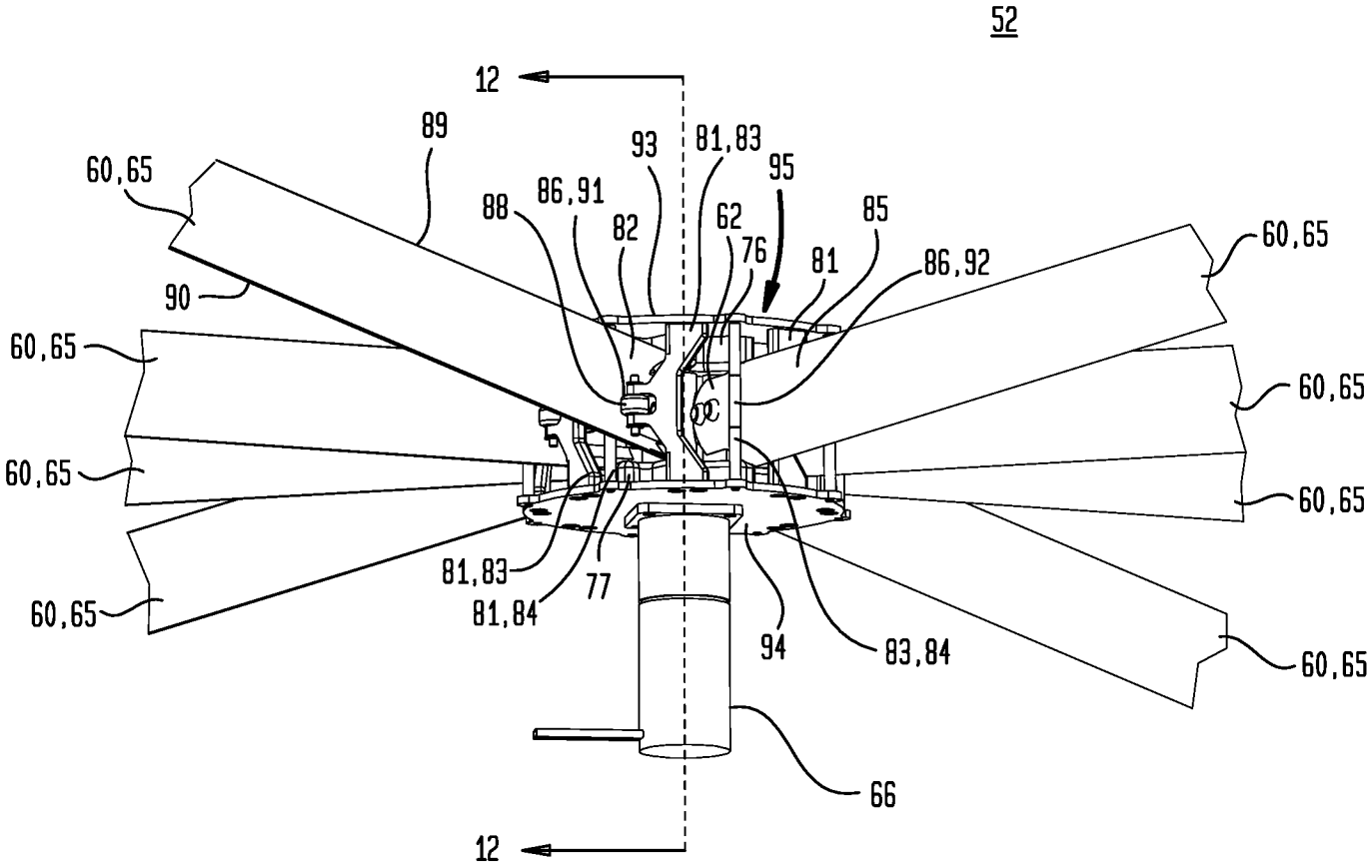
FIG. 11 illustrates a perspective view of an embodiment of the hub assembly of the truss deployment assembly shown FIG. 8.
Figure 12:
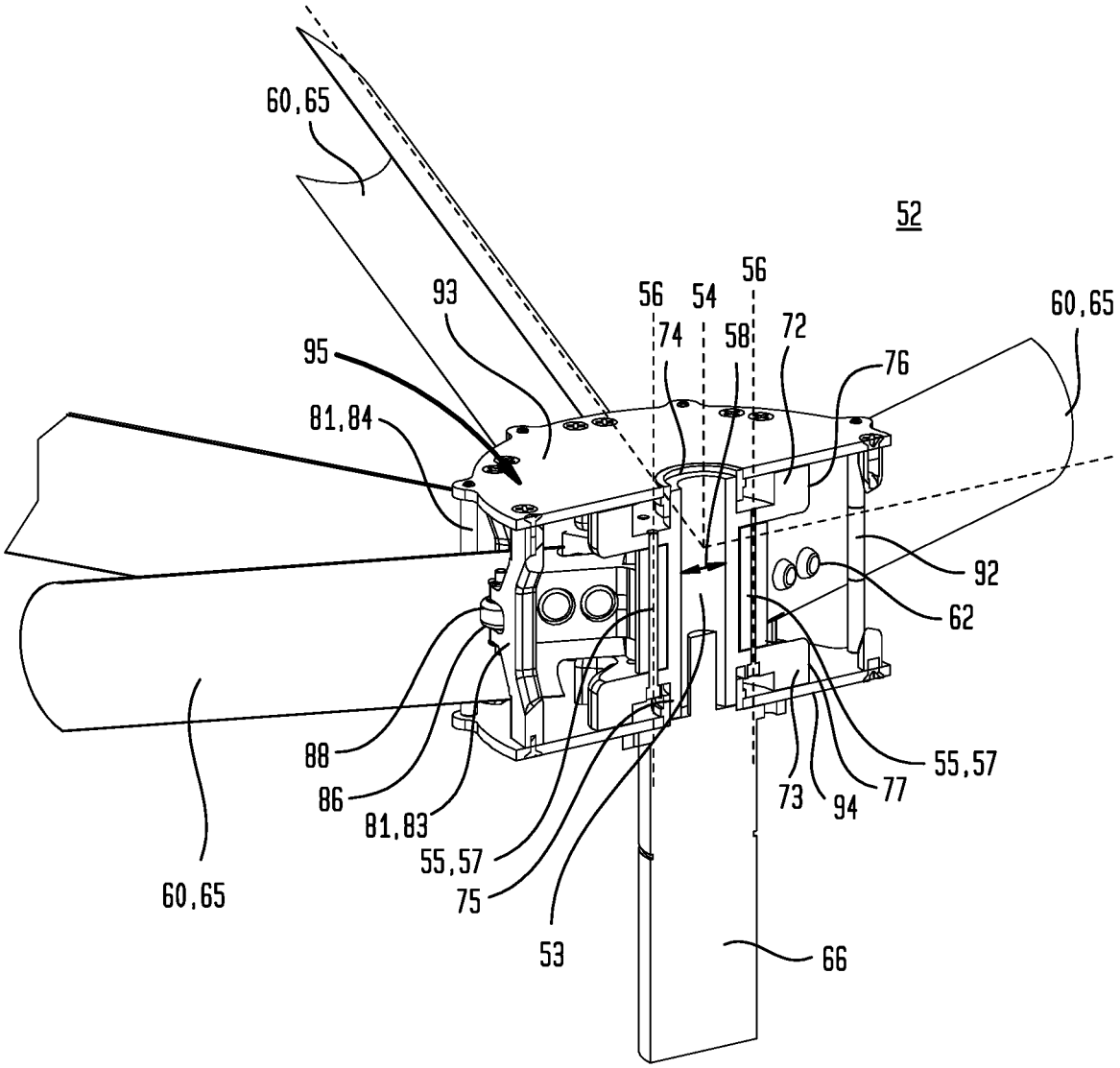
FIG. 12 illustrates a perspective cross section view 12-12 shown in FIG. 11 of the hub assembly of the truss deployment assembly shown FIG. 8.
Figure 13:
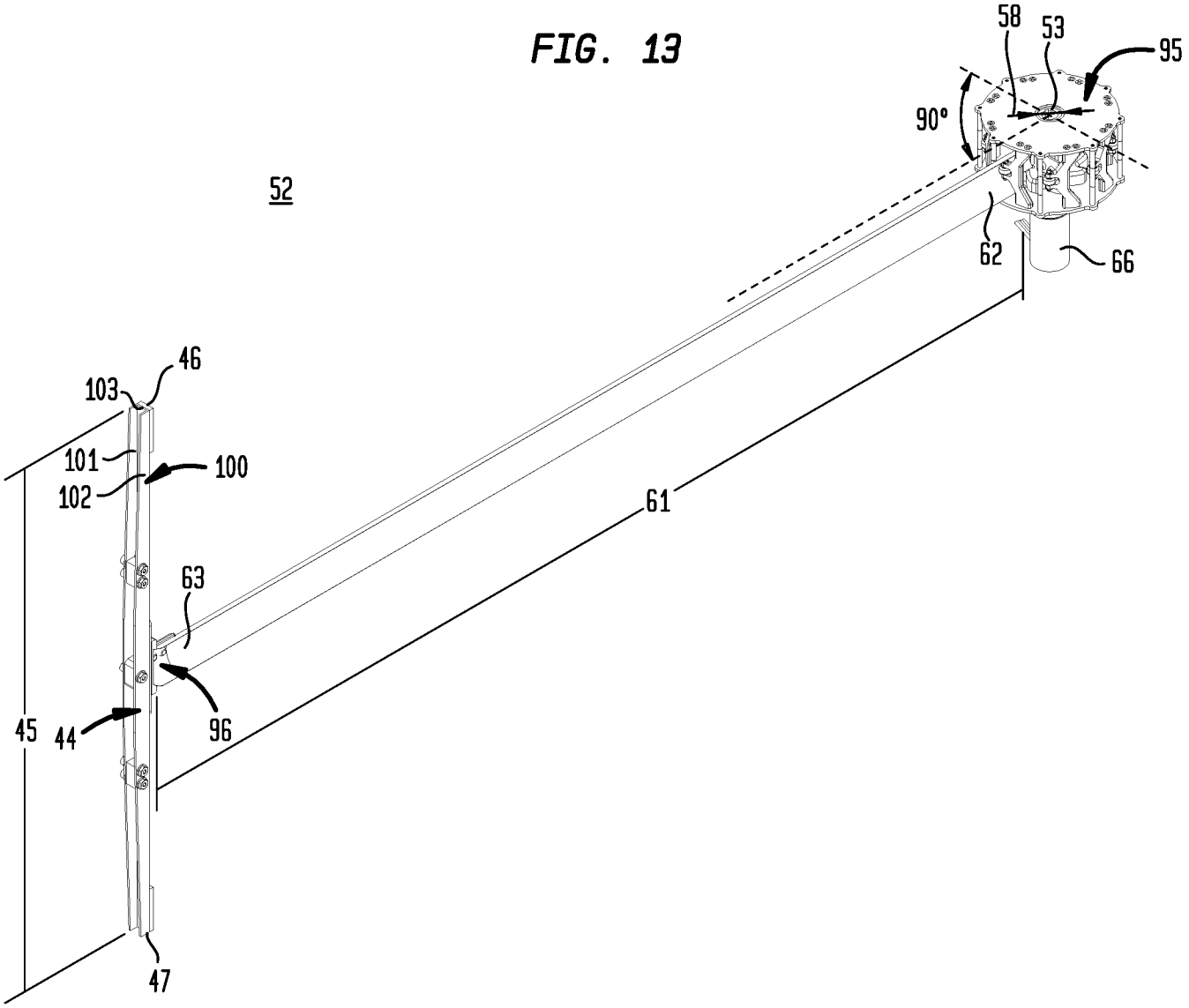
FIG. 13 illustrates a perspective view of the hub assembly and one of a plurality of ribs correspondingly coupled to a batten of the embodiment of a truss deployment assembly.
Figure 14:
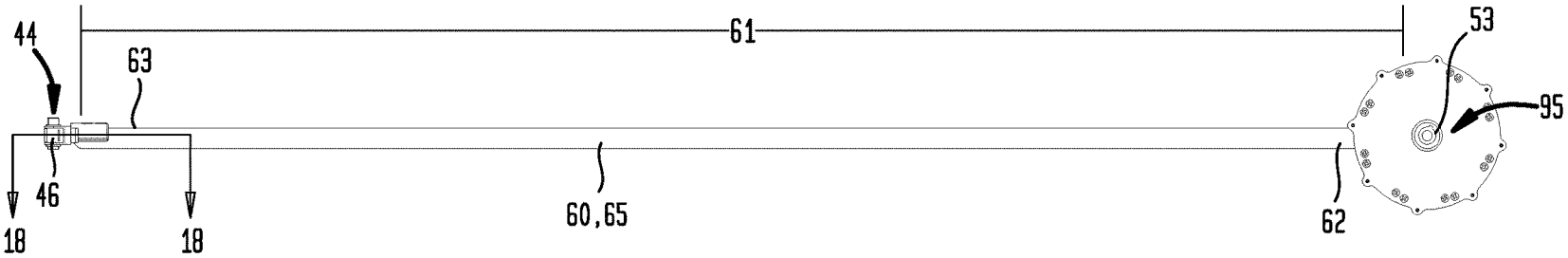
FIG. 14 illustrates a top plan view of the hub assembly and one of a plurality of ribs correspondingly coupled to a batten of the embodiment of a truss deployment assembly.
Figure 15:
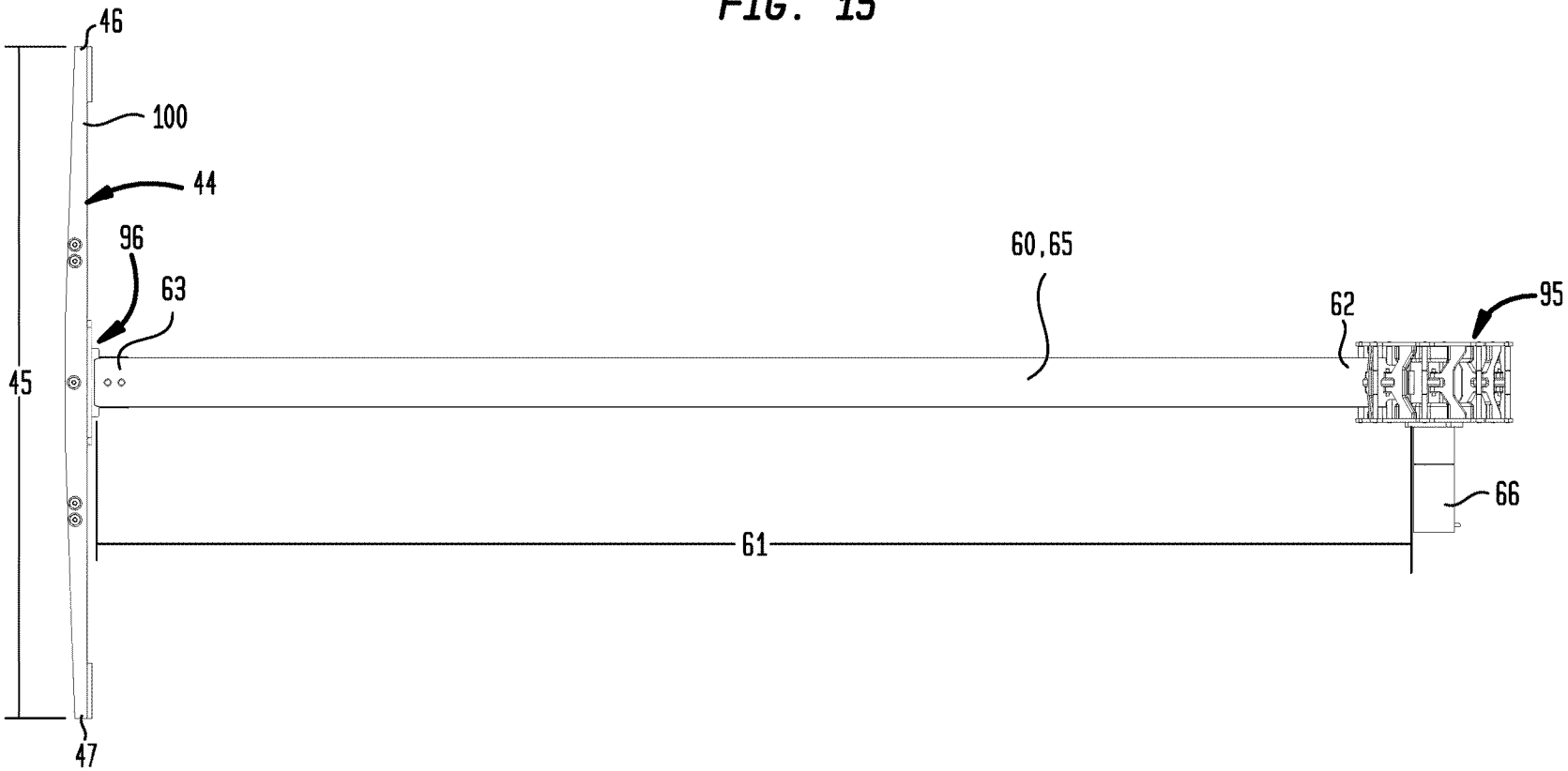
FIG. 15 illustrates a side plan view of the hub assembly and one of a plurality of ribs correspondingly coupled to a batten of the embodiment of a truss deployment assembly.
Figure 20:
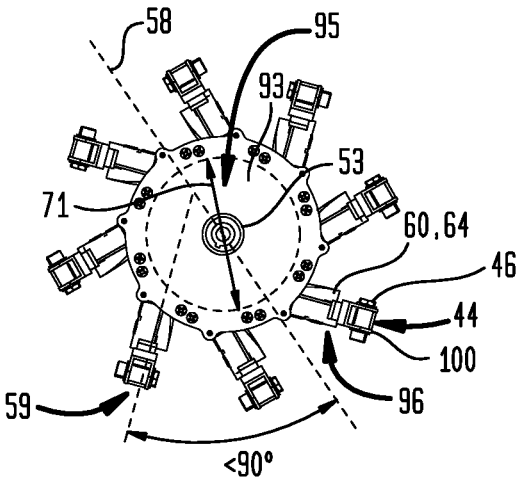
FIG. 20 illustrates a top plan view of the embodiment of the stowed condition of the truss deployment assembly shown in FIG. 19.

Now referring primarily to FIGS. 9A, 9B, 10 through 12 and 20, a plurality of pivoters (55) can, but need not necessarily, be circumferentially disposed in spaced apart intervals around the spool (53) with each of the pivoters (55) rotatable about a pivoter axis (56)(as shown in the example of FIG. 12) from a first pivoter position (57) generally perpendicular to a diameter (58) of the spool (53)(as shown in each of FIGS. 9-12 each of the plurality of pivoters (55) in the first pivoter position (57) can be generally aligned with the perpendicular bisector of the diameter (58) of the spool (53))(as shown in the illustrative example of FIG. 10) and sweeping toward the diameter (58) of the spool (53) to a second pivoter position (59) oblique to the diameter (58) of the spool (as shown in the illustrative example of FIG. 20).

Now referring to FIGS. 9A, 9B and 10 through 19, particular embodiments of the truss deployment assembly (52) can include a plurality of ribs (60) each having a rib length (61) disposed between a rib first end (62) and a rib second end (63). One of the rib first ends (62) can be correspondingly coupled to one of the plurality of pivoters (55) and one of the rib second ends (63) can be correspondingly coupled to one the plurality of battens (44). However, as to particular embodiments, each rib first end (62) can be connected to the spool (53) omitting the plurality of pivoters (55). The spool (53) can be reversibly rotated about the spool longitudinal axis (54) to correspondingly reversibly wind the plurality of ribs (60) around the spool (53) to radially position (radially extend and retract) the rib second ends (63) between a wound retracted condition (64)(as shown in the example of FIG. 20) and an unwound radially extended condition (65)(as shown in the examples of FIGS. 1-6, 8, 13-15). Embodiments can, but need not necessarily, include a motor (66) coupled to the spool (53) operable to reversibly rotate the spool (53) to move the plurality of ribs (60) radially between the wound retracted condition (64) and the unwound radially extended condition (65).

Now referring primarily to FIG. 9A, the plurality of ribs (60) can be formed as a slit tube (67) of composite laminates or metallic materials, or a combination thereof. As illustrative examples, the plurality of ribs (60) can be constructed as a laminate composite comprised of a plurality of thin layers of composite fibers, such as: carbon, aramid, glass, quartz fibers, and combinations thereof, which can be woven or unwoven and pre-impregnated or impregnated with a resin matrix, such as: epoxy resin, phenol resin, amino plastic resin, melamine resin or the like, which can be bonded together by autoclave or out-of-autoclave curing processes which apply heat and pressure to the plurality of thin layers and resin matrix to produce the plurality of ribs (60) that can be reversibly wound around the spool (53). Composite laminates can be take the form of bi-stable laminates having a structure that can be stable both in the unstrained, unwound radially extended condition (65) and in the strained wound retracted condition (64) which allows for a reduced volume wound retracted condition (64) with less blooming effects than traditional laminates; however, this is not intended to preclude embodiments which utilize conventional laminates which may afford higher deployment forces to passively drive the plurality of ribs (60) toward the unwound radially extended condition (65). Additionally, embodiments of the plurality of ribs (60) can be structured as a collapsible and rollable truss boom comprised of two more elongate bi-stable composite members and associated diagonals. The truss boom can be stable both in the fully unwound radially extended condition (65) and wound retracted condition (64).

Again, referring primarily to FIG. 9A, embodiments of the slit tube (67) can have a slit tube diameter (68) of between about 2 centimeters ("cm") to about 3 cm; however, this does not preclude embodiments having a greater or lesser slit tube diameter (68). Each of the plurality of ribs (60) can have a total included angle (69) of a tubular cross section orthogonal to a slit tube longitudinal axis (70) of about 180 degrees to about 350 degrees. The slit tube diameter (68) and the included angle (69) of the tubular cross section can be combined in various permutation with the slit tube diameter (68) incrementally increasing in about 0.1 cm increments and the total included angle (69) incrementally adjusted in about 5 degree increments depending upon the slit tube material, the rib length (61) and the amount of force applied to the truss (12) to achieve the truss deployed condition (43). As illustrative examples, the slit tube (67) can be a composite of carbon and quartz fibers with a diameter of about 1.9 cm and a total included angle of about 240 degrees, or the slit tube (67) can be a composite of carbon and quartz fibers can have a 2.5 cm diameter with an included angle of about 350 degree each being wound around the spool (53) with an inside wound diameter (71)(as shown in the example of FIG. 20) of about 2.5 cm to about 3.5 centimeters. These illustrative examples are not intended to preclude other slit tub diameters (68), total included angle (69), or inside wound diameter (71); rather these illustrative examples provide sufficient examples to allow the structure of the plurality of ribs (60) to be scaled depending upon the application.

Figure 9B:
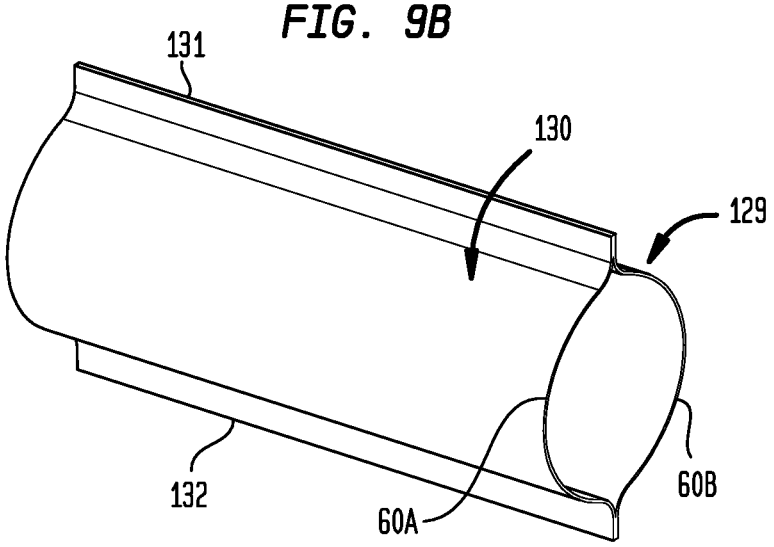
FIG. 9B illustrates a partial perspective view of an alternate embodiment of a rib that can be coupled to the spool shown in FIG. 9A.

Now referring primarily to FIG. 9B, as to particular embodiment the plurality of ribs (60) can, but need not necessarily, be formed in a closed cross section (129) which can be collapsed to a generally flat condition and wound around the spool (53). The closed cross section (129) can, but need not necessarily, be a lenticular structure (130) comprised of a pair of convex ribs (60A)(60B) interconnected or joined at the corresponding pairs of edges (131)(132).

Now referring primarily to FIGS. 9 and 12, embodiments can, but need not necessarily, include an upper spool flange (72) and a lower spool flange (73) correspondingly joined at opposite spool ends (74)(75) of the spool (53), where the upper and lower spool flanges (74)(75) extend radially outward of the spool (53) to define upper and lower spool flange perimeter edges (76)(77). As shown in FIG. 9, the plurality of pivoters (55) can be disposed between the upper spool flange (72) and the lower spool flange (73). As to particular embodiments, each of the upper spool flange (72) and the lower spool flange (73) can, but need not necessarily, include a plurality of rib intercept elements (78) disposed in spaced apart intervals around the upper or lower spool flange perimeter edges (76)(77). Each of the plurality of ribs (60) can have a lesser rib width (79) proximate the rib first end (62) coupled to the pivoter (55). The portion of the rib length (61) having the lesser rib width (79) can wind around the spool (53) between the upper and lower spool flanges (72)(73). The remaining portion of the rib length (61) having a greater rib width (80) can be intercepted by the plurality of rib intercept elements (78) to wind around the upper and lower spool flange perimeter edges (76)(77).

Now referring primarily to FIGS. 10 through 12, embodiments can, but need not necessarily, include a plurality of rib guides (81) disposed in spaced apart intervals around the spool longitudinal center axis (54) radially outward of the plurality of pivoters (55). One of the plurality of rib guides (81) correspondingly engages a rib first face (82) of one of the plurality of ribs (60) to positionally guide the corresponding one of the plurality of ribs (60) during radial extension and retraction between the wound retracted condition (64) and the unwound radially extended condition (65). As shown in the Figures, a particular embodiment of the plurality of rib guides (81) can terminate in a roller (86) which rotatably engages the rib first face (82); however, this is not intended to preclude embodiments of the plurality of rib guides (81) which terminate in a rib guide face (87) which slidably engages the rib first face (82). As to particular embodiments, each of the plurality of rib guides (81) can comprise a pair of rib guides (83)(84)(as shown in the example of FIG. 11), a first of the pair of rib guides (81)(83) engaging the rib first face (82) and a second of the pair of rib guides (81)(84) engaging a rib second face (85). The first and second of the pair of rib guides (83)(84) can be correspondingly engaged to the rib first face (82) and the rib second face (85) in direct opposite relation in which both the first and second of the pair of rib guides (83)(84) engage the rib first and second face (82)(85) at substantially the same or the same distance radially outward of the corresponding one of the plurality of pivoters (55), or in offset opposite relation where either the first or the second rib guide (83)(84) engages the corresponding one of the plurality of ribs (60) radially outward of the other. The first or the second of the pair of rib guides (83)(84), or both, can terminate in a roller (86). The first or second of the pair of rib guides (83)(84) (whether terminating in a rib guide face (87) or rib guide roller (86)) engaging the first and second rib face (82)(85) can vary structurally. For example, the first of the pair of rib guides (83) engaging the first rib face (82) having a concave or inwardly curving surface may have a rib guide face (87) or perimetrical roller face (88) of lesser height than the second of the pair of rib guides (84) engaging the second rib face (85) having a convex or outwardly curving surface which may have a greater height.

As a first illustrative example, referring primarily to FIG. 11, the first of the pair of rib guides (81)(83) can terminate in a first roller (86)(91) which medially rotatingly engages a rib first face (82) between opposite rib edges (89)(90) and a second of the pair of rib guides (84) can terminate in a second roller (92) which medially rotatingly engages a rib second face (85) between opposite rib edges (89)(90) at substantially the same or the same distance radially outward of the corresponding one of the plurality of pivoters (55).

As a second illustrative example, referring primarily to FIG. 10, the first of the pair of rib guides (81)(83) can terminate in a first roller (91) which laterally rotatingly engages a rib first face (82) proximate one of the rib edges (89)(90) and a second of the pair of rib guides (81)(84) can terminate in a second roller (92) which laterally rotatingly engages a rib second face (85) proximate the same rib edge (89) or (90) at substantially the same or the same distance radially outward of the corresponding one of the plurality of pivoters (55).

Now primarily referring to FIGS. 11 and 12, embodiments can, but need not necessarily include, an upper hub plate (93) disposed opposite a lower hub plate (94) each correspondingly disposed axially outward of the upper spool flange (72) and a lower spool flange (73), respectively, between which the spool (53) rotatably mounts and between which the plurality rib guides (55) can be affixed radially outward of the spool (53)(collectively referred to as the "hub assembly" (95)). The motor (66) can be affixed to either the upper or lower hub plate (93) or (94) to rotate the spool (53) relative to the upper and lower hub plates (93)(94) to move the plurality of ribs (60) radially between the wound retracted condition (64) and the unwound radially extended condition (65) where each of the plurality of pivoters (55) pivot toward the first pivoter position (57) aligned generally perpendicular to a diameter (58) of the spool (53) at which each of the plurality of ribs (60) align generally perpendicular to the diameter (58) of the spool (53) with the truss (12) in the deployed condition (43).

Now referring primarily to FIGS. 13 through 18, particular embodiments, can but need not necessarily, include a batten-rib interface assembly (96) which couples a rib second end (63) to a corresponding one of the plurality of battens (44). The batten-rib interface assembly (96) includes one or more of: a resilient springing element (97); an interface body (98) configured to movingly engage the resilient springing element (97); and an interface flange (99) outwardly extending from the interface body (98) to couple the rib second end (63).

As shown in FIGS. 13 through 18, as to particular embodiments, each of the plurality of battens (44) can, but need not necessarily, comprise an elongate open channel (100) having a pair of channel sides (101)(102) disposed in opposed relation a distance apart joined by a channel base (103); however, this description is not intended to preclude the use of a plurality of battens (44) comprising elongate solid or tubular elements.

Figures 16, 17, 18:
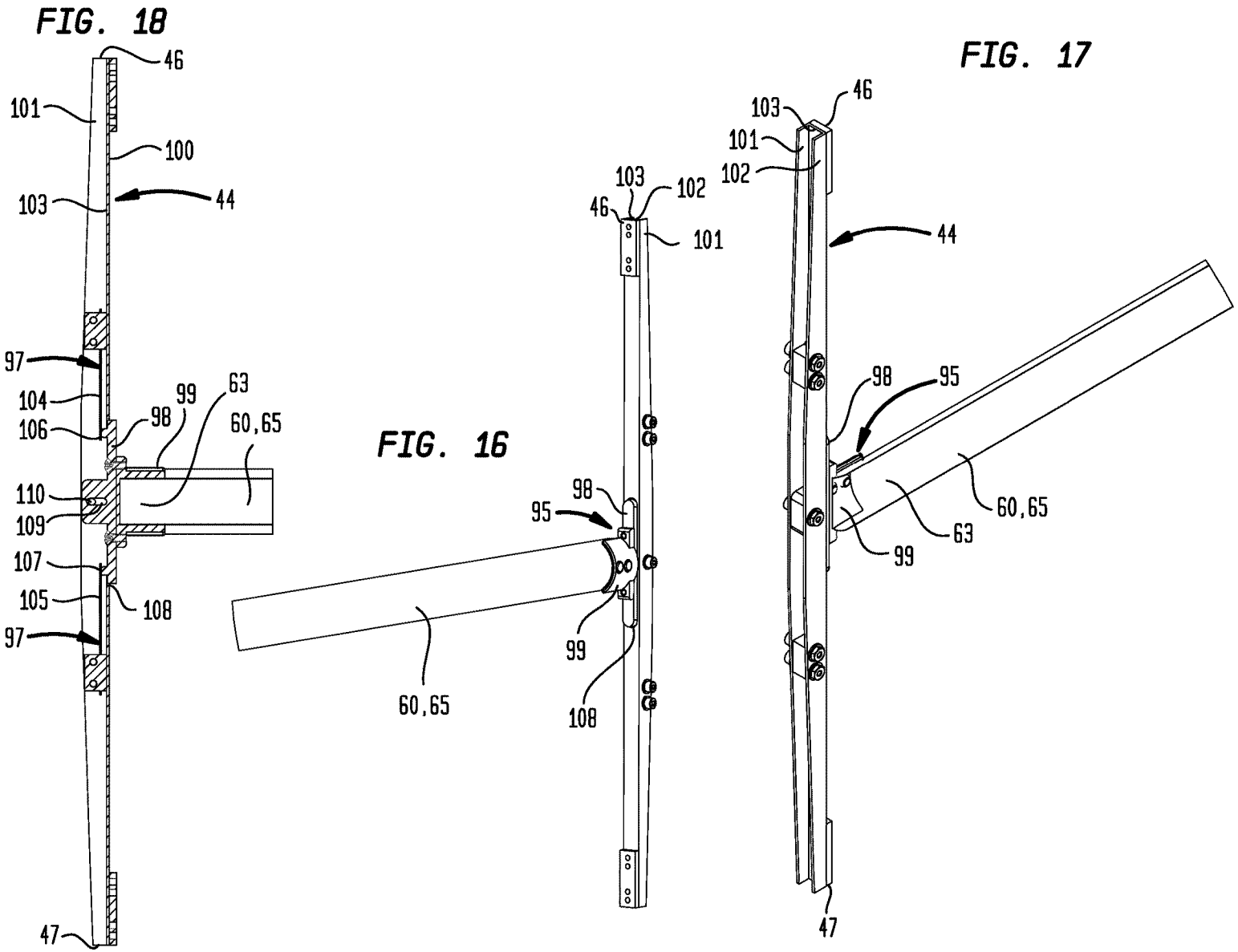
FIG. 16 illustrates a first perspective view of a batten-rib interface assembly of the embodiment of a truss deployment assembly shown in FIG. 8.
FIG. 17 illustrates a second perspective view of the batten-rib interface assembly of the embodiment of a truss deployment assembly shown in FIG. 8.
FIG. 18 illustrates a side cross section view 18-18 of the batten-rib interface assembly shown in FIG. 14.

Now referring to primarily to FIG. 16 through 18, the resilient springing element (97) deflects in response to loading from extension of a corresponding one of the plurality of ribs (60) and corresponding tensioning of the truss (12). While the embodiment shown in FIG. 18 includes a pair of resiliently flexible members (104)(105) having a pair of member first ends each attached to a corresponding one of the plurality of battens (44) to dispose a pair of member second ends (106)(107) in opposed relation a distance apart inside the elongate open channel (100), with each of the pair of member second ends (106)(107) resiliently deflecting in response to movement of the interface body (98); this illustrative example does not preclude other embodiments of the resilient springing element (97), including elastic springing media, such as springs, elastomers, or pneumatic cylinders.

The interface body (98) can be joined to the corresponding one of the plurality of battens (44) to movingly engage the resilient springing element (97). Particular embodiments, have delimited telescopic engagement with the batten (44), or delimited movement within a batten aperture element (108) or pass through disposed in the batten (44). As shown in FIG. 18, the interface body (98) can be slidably disposed in the batten aperture element (108) of the batten (44) to engage the pair member second ends (106)(107) of the resilient springing element (97). The batten aperture element (108) and interface body (98) can be configured to mitigate radial movement of the interface body (98) in relation to the batten (44) (as shown in the example the interface body has an elongate form slidably engaged in an elongate aperture element). The axial movement of the interface body (98) can be delimited by the length of an elongate slot (109) disposed in the interface body (98) which slidably engages a pin (110) having a fixed position in relation to the batten (44).

The interface flange (99) extends from the interface body (98) to receive the rib second end (63). The interface flange (99) can, but need not necessarily, have a curved surface (111) to receive the correspondingly curved surface of the rib first or second face (82)(85). The rib second ends (63) of the plurality of radial ribs (60) can be axially joined to the interface flange (99) at two or more points to mitigate in-plane rotation at this joint. As shown in the illustrative embodiment, two holes can be disposed axially in the interface flange (99) and correspondingly two holes can be disposed proximate the rib second end (63) to receive mechanical fasteners.

The batten-rib interface assembly (96) allows the loading force of the plurality of ribs (60) to be transferred to the resilient springing element (97) when extending the plurality of radial ribs (60) to the unwound radially extended condition (65) to achieve the deployed condition (43) of the truss (12). The transfer of the loading forces to the resilient springing element (97) can make the plurality of ribs (60) less sensitive to thermal distortions and a wider range of manufacturing tolerances. The batten first and second ends (46)(47) can further include a plurality of net guide dowel pins, string adjustment screws, or clamps configured to attach and adjust first and second longerons (46)(47) and first and second diagonal members (50)(51).

Figure 21:
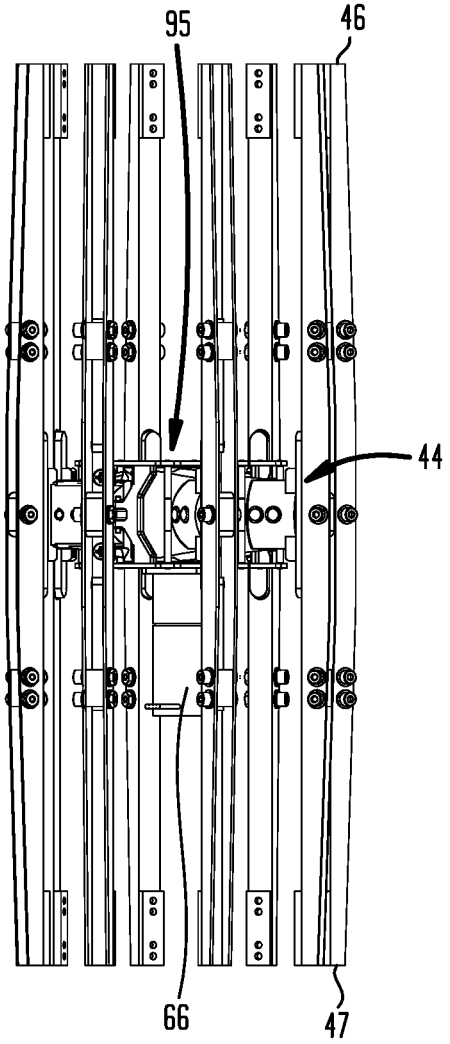
FIG. 21 illustrates an elevation view of the embodiment of the stowed condition of the truss deployment assembly shown in FIG. 19.
Figure 19:
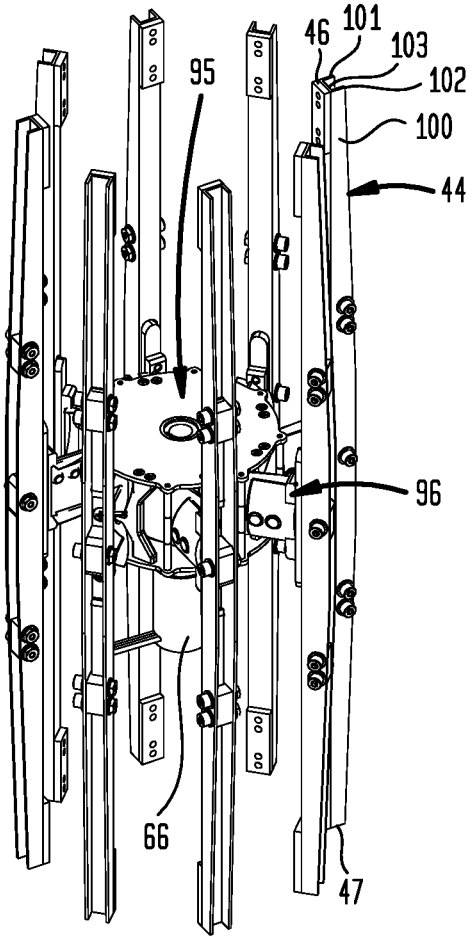
FIG. 19 illustrates a perspective view of an embodiment of the stowed condition of the truss deployment assembly shown in FIG. 8 with omission of the longerons and diagonal members.

Now referring to FIGS. 19 to 21, from the deployed condition (43), the reflector assembly (1) can be returned to the stowed condition (42) by rotating the spool (53), to wind the plurality of ribs (60) around the spool or the upper and lower spool flanges (72)(73), depending on the embodiment, causing the truss (12) inclusive of the plurality of battens (44), first or second longerons (48)(49), first or second diagonal members (50)(51), first or second nets (2)(7), and first or second reflectors (21)(22) to radially collapse. The first or second nets (2)(7) and the first or second reflectors (21)(22) can be pleated such as to fold as the plurality of ribs (60) assume the wound retracted condition (64).

Figure 22:
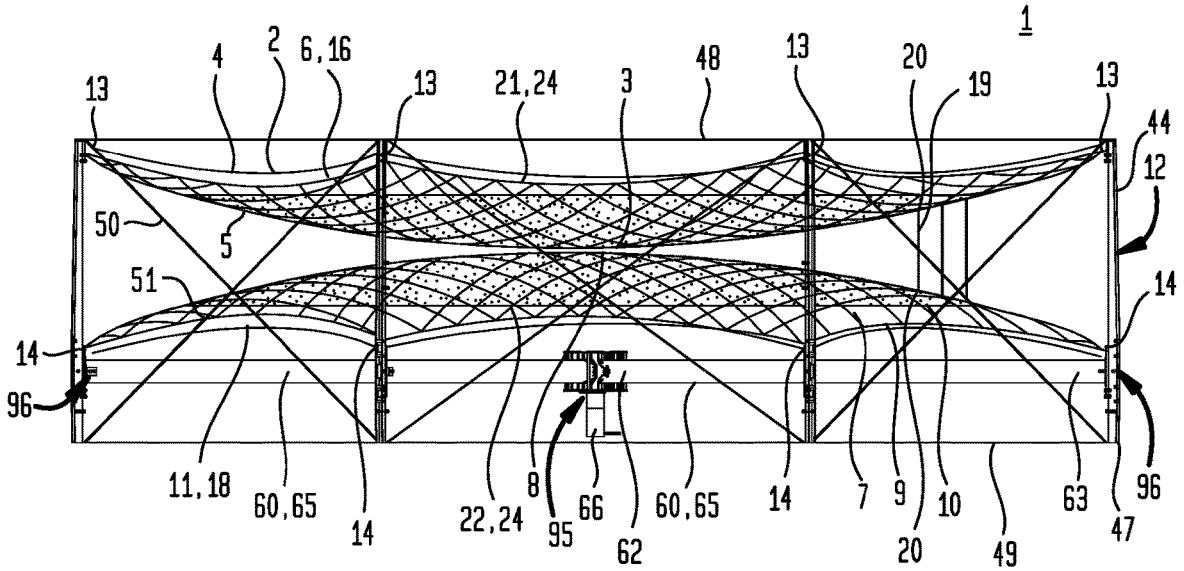
FIG. 22 illustrates an embodiment of the reflector assembly having the hub assembly disposed to one side of the reflector assembly outward of the first net or the second net outer surface.

Now referring primarily to FIGS. 1 and 2 and 22, as to particular embodiments, each of the rib second ends (63) can be correspondingly medially coupled (or laterally coupled proximate a batten first or second end) to one of the plurality of battens (44) along the batten length (45). As shown in the illustrative examples of FIGS. 1 and 2, the rib second ends (63) can, but need not necessarily, be correspondingly medially coupled to the plurality of battens (44) to dispose the hub assembly (95) between the first and second nets (2)(7). As shown in the illustrative example of FIG. 22, the plurality of rib second ends (63) can, but need not necessarily, be laterally coupled proximate a batten first or second end (46)(47) disposes the hub assembly (95) to one side of the reflector assembly (1)(outward of the first net (2) or the second net (7) outer surface (6)(11)). While the embodiment shown includes a first net (2) and a second net (7) correspondingly having a parabolic first net outer surface (16) and a parabolic second net outer surface (18); this is not intended to preclude embodiments having a flat first net outer surface (16) or a flat second net outer surface (17). As to particular embodiments, the hub assembly (95) can be disposed to one side of a flat first net outer surface (16) and a flat second net outer surface (17). As to particular embodiments the flat first net outer surface (16) and the flat second net outer surface (17) can be disposed a distance apart of about one-half inch to about five inches apart. For example, a particular embodiment disposes the flat first net outer surface (16) and the flat second net outer surface (17) a distance apart of about one inch.

Figure 23:
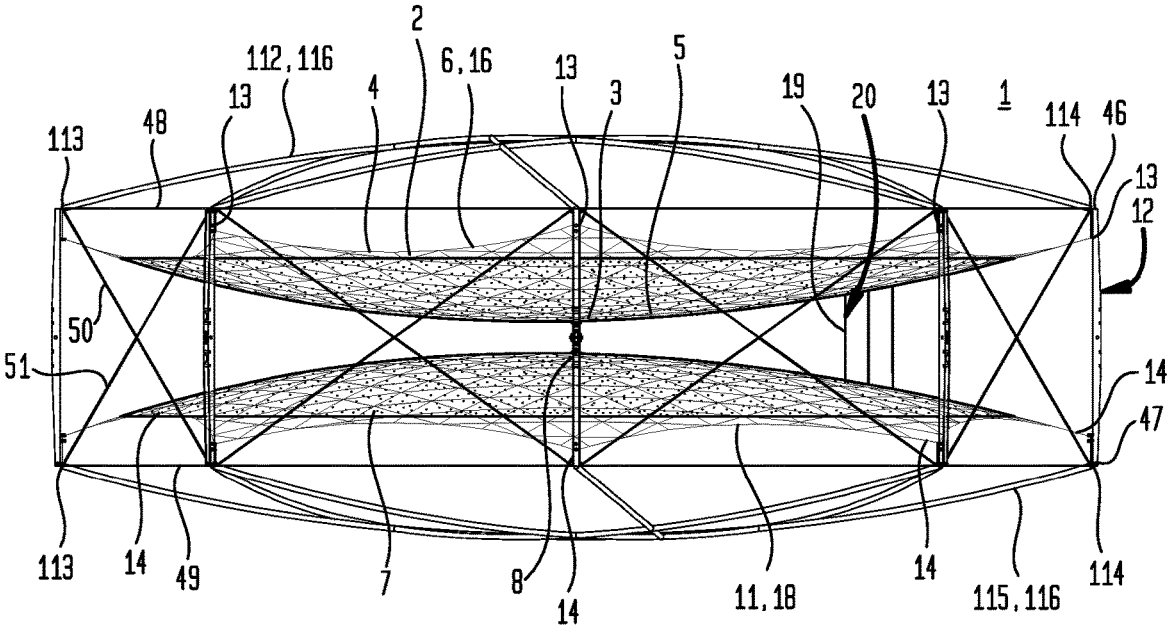
FIG. 23 illustrates an embodiment of the reflector assembly having a truss tensioned by a first or second resilient rod assembly.

Now referring primarily to FIG. 23, as to particular embodiments, the truss (12) can, but need not necessarily, be disposed in the deployed condition (43) by a first resilient rod assembly (112) extending over the first net (2) with opposite rod ends (113)(114) correspondingly coupled to a pair of the plurality of batten first ends (46). Embodiments can, but need not necessarily, further include a second resilient rod assembly (115) extending over the second net (7) with opposite rod ends correspondingly coupled to a pair of the batten second ends (47). The first or second resilient rod assembly (112)(115) can include one or more resilient rods (116) which can maintain the truss (12) in a deployed condition (43) generating a tension in the first net (2) or the second net (7) to maintain a substantially flat or parabolic net outer surface (15)(17) correspondingly extending from the first net center (3) to the first net perimeter edge (4) or the second net center (8) to the second net perimeter edge (9).

Figure 24:
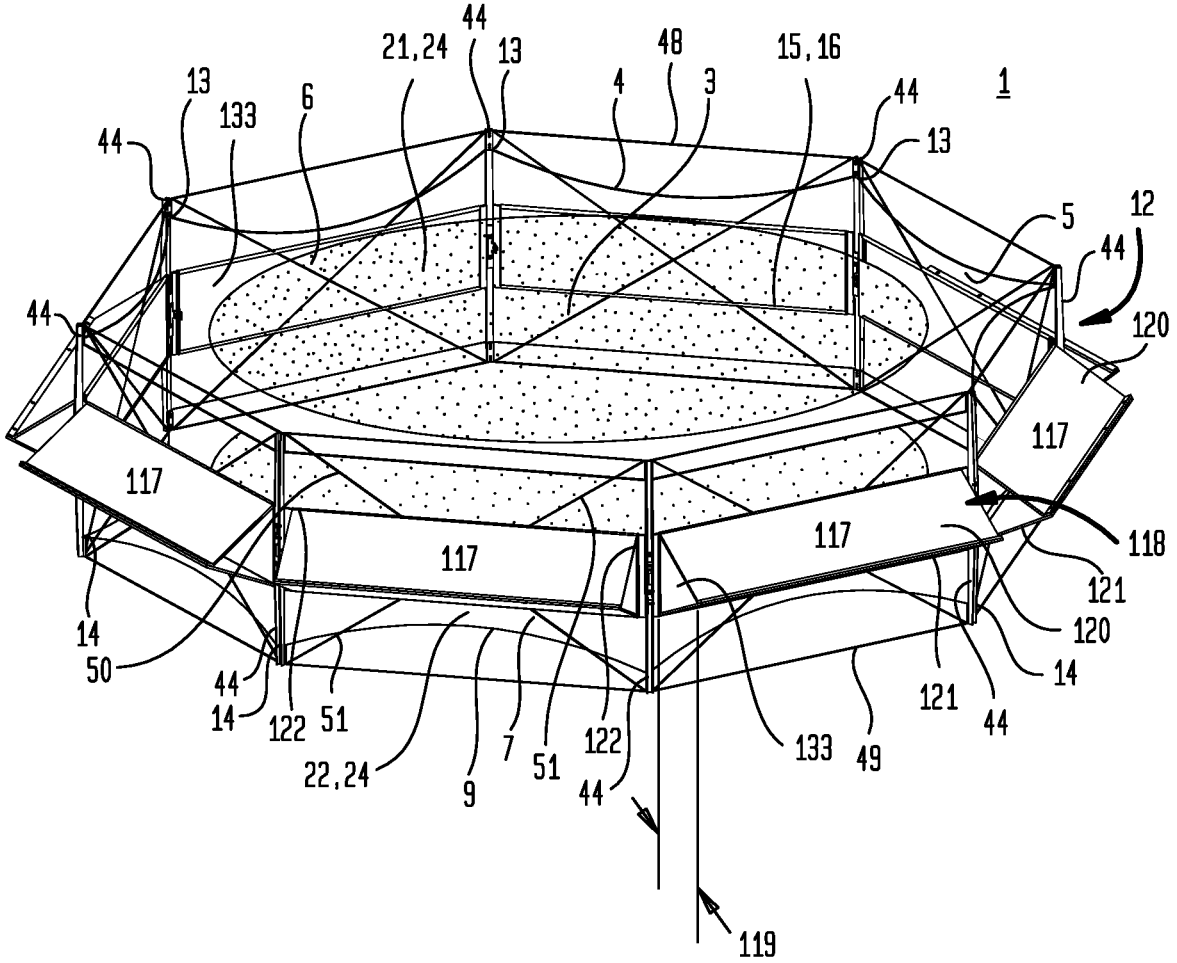
FIG. 24 illustrates an embodiment of the reflector assembly having a truss tensioned by a plurality of perimeter longerons.

Now referring primarily to FIG. 24, as to particular embodiments, the truss (12) can be disposed in the deployed condition (43) by disposing a plurality of perimeter longerons (117) between adjacent ones of the plurality of battens (44). The perimeter longerons (117) can be an erectable or unfolding structure (118) having sufficient structural depth (119) to maintain in-plane axial and shear stiffness as well as flexural and torsional stiffness in the truss (12) deployed condition (43). The illustrative example of the plurality of perimeter longerons (117) includes a two panels (120)(121) or three panels (120)(121)(133) removably connected between adjacent pairs of the plurality of battens (44) by at least each of four corners (122) to achieve the deployed condition (43) of the truss (12) generating a tension in the first net (2) and the second net (7) to maintain a substantially flat or parabolic net outer surface (15)(17) correspondingly extending from the first net center (3) to the first net perimeter edge (4) or the second net center (8) to the second net perimeter edge (9). The two panels (120)(121) can be medially hinged to unfold and removably connect between adjacent pairs of the plurality of battens (44). The three panel (120)(121)(133) embodiment can be hinged to allow one of the three panels (120)(121)(133) to be removably connected between adjacent pairs of the plurality of battens (44) and the remaining two panels (12) rotated about a corresponding pair of hinges to engage a distance (119) outwardly of the truss (12).

Figure 25:
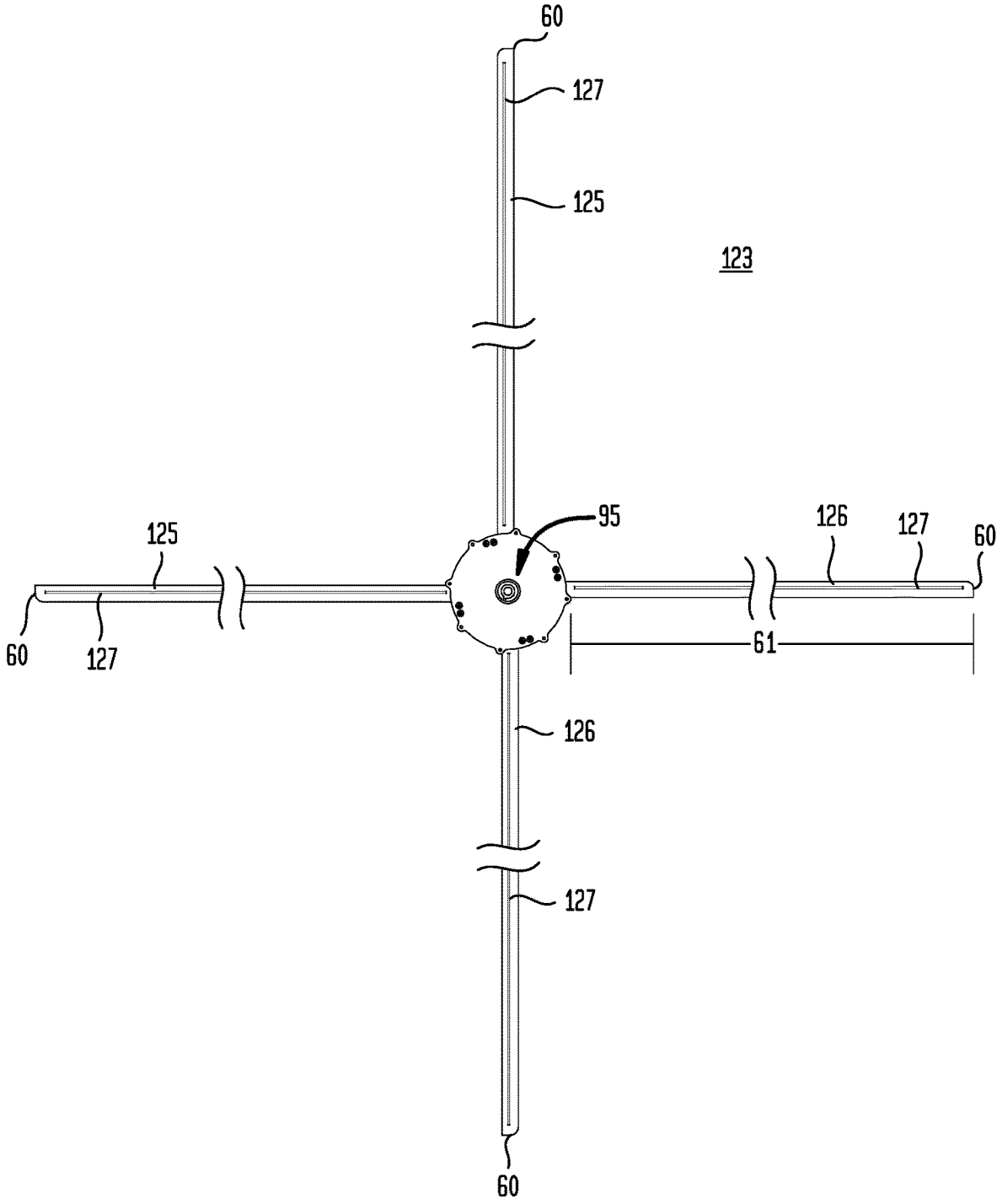
FIG. 25 illustrates an embodiment of a single or a multi-axis antenna including one or more pairs of extensible retractable opposing ribs further including an electrically conductive element extending between a rib first end and a rib second end.

Now referring primarily to FIG. 25, embodiments of the plurality of ribs (60) can be configured to provide an antenna (123). The plurality of ribs (60) in antenna (123) embodiments include electrically conductive materials (127) or electrically conductive paths disposed along the rib length (61) such as metallic ribs, composite laminates having an electrically conductive layer, or an electrically conductive path, element, mesh, or wire, or combinations thereof. The antenna (123) can be multi-axis dipole antenna (124) including a plurality of ribs (60) having two or more pairs of extensible retractable opposing ribs (125)(126)(two pairs of opposing ribs (125)(126) shown in the illustrative example); however, this is not intended to preclude antennas (123) configured as single axis dipole antenna (127) including only two extensible retractable opposing ribs (125). The positional accuracy and stability of the dipoles may be enhanced with some combination of a plurality of battens (60), longerons (48), diagonal members (50), and radial strings or nets.

As can be easily understood from the foregoing, the basic concepts of the present invention may be embodied in a variety of ways. The invention involves numerous and varied embodiments of a deployable reflector system and methods for making and using such deployable reflector system including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or method may be described by an apparatus term or method term. Such terms can be substituted where desired to make explicit the implicitly broad coverage to which this invention is entitled. As but one example, it should be understood that the elements of a method may be disclosed as an action, a means for taking that action, or as an element which causes that action. Similarly, each element of an apparatus may be disclosed as the physical element or the action which that physical element facilitates. As but one example, the disclosure of a "reflector" should be understood to encompass disclosure of the act of "reflecting"—whether explicitly discussed or not—and, conversely, were there effectively disclosure of the act of "reflecting", such a disclosure should be understood to encompass disclosure of a "reflector" and even a "means for reflecting." Such alternative terms for each element are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the deployable reflectors herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. An apparatus, comprising:

a first net extending from a first net center to a first net perimeter edge, said first net having a first net inner surface and a first net outer surface;

a second net extending from a second net center to a second net perimeter edge, said second net having a second net inner surface facing said first net inner surface;

a truss including a plurality of battens each having a batten length disposed between a batten first end and a batten second end, each of said plurality of battens extending between one of a first plurality of points of said first net and a corresponding aligned one of a second plurality of points of said second net; and a truss deployment assembly operable to position said truss between a truss stowed condition and a truss deployed condition, said truss deployment assembly removably connected between at least two of said plurality of battens of said truss to position said truss in said truss deployed condition tensioning said first net or said second net to maintain a substantially flat or parabolic first or second net outer surface, said truss deployment assembly disconnected from between at least two of said plurality of battens of said truss to position said trust in said truss stowed condition.

2. The apparatus of claim 1, further comprising a plurality of tension ties extending between corresponding net polyhedron vertices of said first net and said second net.

3. The apparatus of claim 1, wherein said truss further includes a first longeron connecting each of said plurality of battens to an adjacent one of said plurality of battens proximate said batten first ends.

4. The apparatus of claim 3, wherein said truss further includes a second longeron connecting each of said plurality of battens to an adjacent one of said plurality of battens proximate said batten second ends.

5. The apparatus of claim 4, wherein said truss further includes a first diagonal member connecting one of said plurality of batten first ends of each of said plurality of battens to an adjacent one of said plurality of batten second ends.

6. The apparatus of claim 5, wherein said truss further includes a second diagonal member connecting said batten second end of each of said plurality of battens to a batten first end of said adjacent one of said plurality of battens.

7. The apparatus of claim 1, further comprising a first reflector disposed at said first net outer surface or a second reflector disposed at said second net.

8. The apparatus of claim 1, further comprising a first reflector disposed at said first net outer surface and a second reflector disposed at said second net, wherein said first reflector having a first reflector surface configured to receive a first frequency band, said second reflector having a second reflector surface configured to receive a second frequency band, said first frequency band delimited by upper and lower frequencies different than said second frequency band.

9. The apparatus of claim 8, wherein said first reflector or said second reflector is selected from the group consisting of: a reflecting membrane, a reflective mesh, a phased array, a reflectarray, and combinations thereof.

10. The apparatus of claim 1, further comprising at least one perimeter longeron removably connectable between adjacent pairs of said plurality of battens to dispose said truss in said deployed condition.

11. The apparatus of claim 10, wherein said at least one perimeter longeron includes removably connected to adjacent pairs of said plurality of battens comprises at least one panel having a depth between a first side opposite a second side.

12. The apparatus of claim 1, further comprising:

a first assembly of one or more elongate rods extendable over said first net with opposite rod ends correspondingly coupled to a pair of batten first ends; and a second assembly of one more elongate rods extendable over said second net with opposite rod ends correspondingly coupled to a pair of batten second ends, said first and second assembly of one or more rods having opposite rod ends correspondingly coupled to said pair of batten first and second ends disposes said truss in said deployed condition.

* * * * *